US005765300A

United States Patent [19]

Kianka

[11] Patent Number: 5,765,300

[45] Date of Patent: Jun. 16, 1998

[54] SHOE ACTIVATED SOUND SYNTHESIZER DEVICE

[76] Inventor: Michael Kianka, 17 Revere Ct., Ewing, N.J. 08628

[21] Appl. No.: 868,848

[22] Filed: Jun. 4, 1997

Related U.S. Application Data

[63] Continuation of Ser. No. 580,342, Dec. 28, 1995, abandoned.

[51] Int. Cl.[6] ..... A43B 23/00

[52] U.S. Cl. ..... 36/139; 36/8.3

[58] Field of Search ..... 36/1, 8.3, 137, 36/139; 73/172

[56] References Cited

U.S. PATENT DOCUMENTS

| | | | |
|---|---|---|---|
| 1,738,177 | 12/1929 | Esmonde . | |
| 1,744,513 | 1/1930 | Smith . | |
| 1,943,222 | 1/1934 | Landi . | |
| 4,043,241 | 8/1977 | Liu | 36/139 X |
| 4,660,305 | 4/1987 | Medler et al. | 36/139 |
| 4,771,556 | 9/1988 | Kim | 36/139 |
| 4,781,097 | 11/1988 | Uchiyama | 84/1.13 |
| 4,909,117 | 3/1990 | Reiling | 84/738 |
| 4,995,294 | 2/1991 | Kashio | 84/738 |
| 5,001,852 | 3/1991 | Schwartz | 36/139 |
| 5,062,341 | 11/1991 | Reiling | 84/702 |
| 5,434,350 | 7/1995 | Haney | 84/743 |
| 5,437,289 | 8/1995 | Liverance et al. | 36/139 X |
| 5,461,188 | 10/1995 | Drago et al. | 36/137 X |
| 5,483,759 | 1/1996 | Silverman | 36/139 X |
| 5,566,479 | 10/1996 | Gray et al. | 36/139 X |

FOREIGN PATENT DOCUMENTS

| | | | |
|---|---|---|---|
| 0522882 | 1/1993 | European Pat. Off. | 36/137 |
| 0589607 | 3/1994 | European Pat. Off. | 36/137 |

*Primary Examiner*—B. Dayoan

*Attorney, Agent, or Firm*—LaMorte & Associates

[57] ABSTRACT

A shoe activated sound synthesizer device that enables movement of a shoe to be translated into audible sounds. The sound synthesizer device consists of a shoe in which there is disposed at least one trigger element capable of producing a trigger signal when the shoe is flexed to a predetermined degree. As the shoe is worn and is brought into contact with the floor, the shoe is flexed. By bringing different parts of the shoe into contact with the floor in a controlled manner, a person can selectively control the production of trigger signals from any trigger element contained within the shoe. A sound synthesizer circuit is provided that is coupled to each trigger element contained within the shoe. The sound synthesizer circuit produces an audible sound, via a speaker, when a trigger signal is received from the shoe.

12 Claims, 4 Drawing Sheets

SHOE ACTIVATED SOUND SYNTHESIZER DEVICE

This is a continuation of application Ser. No. 08/580,342, filed on Dec. 28. 1995, entitled SHOE ACTIVATED SOUND SYNTHESIZER, now abandoned.

BACKGROUND OF THE INVENTION

1. Field of the Invention

The present invention relates to sound synthesizer devices that are coupled to a shoe, whereby the flexure of different parts of the shoe by movements of the foot and contact with the floor causes the sound synthesizer device to produce a variety of audible sounds.

2. Statement of the Prior Art

There are many devices in the prior art record that amplify, enhance or supplement the sound a shoe makes when striking the floor. One of the oldest such prior art devices are metal taps for tap shoes, wherein the metal taps produce a sharp percussion sound when struck against a hard floor surface. Although tap shoes contain different sized taps at different positions on the sole of the shoe, the ability to vary the sound produced by the taps is very limited. Similarly, the ability to control the volume of the sound created by the taps is also limited. In an attempt to increase the volume of tap shoes, taps have been created with resonating chambers that amplify the sound of the tap. Such prior art taps are exemplified by U.S. Pat. No. 1,738,177 to Esmonde, entitled RESONATING DANCING PLATE; U.S. Pat. No. 2,200,848 to Mandalian, entitled SOUND PRODUCING DEVICE FOR A TAP DANCING SHOE; and U.S. Pat. No. 1,943,222 to Landi, entitled MUSICAL TAP DANCING SHOE.

Although the sound of tap shoes can be enhanced, the range of sounds capable of being emitted from tap shoes is still relatively limited. The few instances in the prior art where the range of sounds generated by shoes has been expanded, has been in the art of novelty shoes. For instance, in U.S. Pat. No. 1,744,513 to Smith, entitled SOUND PRODUCING DANCING SHOE, an electrical switch is provided on the sole of the shoe. When the switch is activated by a toe on the foot, an electrical connection is made that rings a bell.

Tap shoes have never been considered a novelty product but rather the necessary equipment for the art form of tap dancing. The reason that tap dancing is considered an art form is that it takes a great deal of skill to create pleasant and coherent rhythms from tap shoes. Novelty status is reserved for many shoes in the prior art that contain bells and other noise makers, where little or no skill is needed in making the shoes produce sound.

With the development of integrated circuits and the production of sound synthesizers using integrated circuits, sound producing assemblies capable of a wide range and variety of sounds are able to be packaged in very small, lightweight units. Sound synthesizer circuitry was once delegated only to expensive musical instruments due to the high cost of such devices. However, as the art developed, the cost of sound synthesizer circuitry plummeted and has found its way into many children's toys and novelty items, such as musical playing greeting cards. Although sound synthesizer technology has be applied to many different products, there has been little integration of sound synthesizer technology into the art of shoes. Certain novelty shoes do exist that produce synthesized music or sounds when a button is manually pressed or when a phototransistor is exposed to light. Such prior art is exemplified by U.S. Pat. No. 4,771,556 to Kim, entitled SPORT SHOE WITH MELODY EMITTING DEVICE. However, with such novelty shoes, the synthesized noise or music produced is not controlled by the movement of the shoe or the manipulation of the shoe by the foot. Consequently, such prior art novelty shoes are entirely removed from the original concept of tap shoes where the skilled manipulation of the shoe results in sounds produced by the shoe.

It is therefore an object of the present invention to integrate sound synthesizer technology with shoes in a manner where the controlled manipulation of the shoe governs the sounds produced by the sound synthesizer, thereby turning the shoes into a musical instrument.

It is a further object of the present invention to provide a shoe structure with integrated triggering mechanisms that can be used in the selective control of a sound synthesizer.

SUMMARY OF THE INVENTION

The present invention is a shoe activated sound synthesizer device that enables movement of a shoe to be translated into audible sounds. The sound synthesizer device consists of a shoe in which there is disposed at least one trigger element capable of producing a trigger signal when the shoe is flexed to a predetermined degree. As the shoe is worn and is brought into contact with the floor, the shoe is flexed. By bringing different parts of the shoe into contact with the floor in a controlled manner, a person can selectively control the production of trigger signals from any trigger element contained within the shoe. A sound synthesizer circuit is provided that is coupled to each trigger element contained within the shoe. The sound synthesizer circuit produces an audible sound, via a speaker, when a trigger signal is received from the shoe.

In a preferred embodiment, multiple trigger elements are contained within the shoe, wherein each of the trigger elements causes the sound synthesizer circuit to produce a different sound or note. As a result, the present invention shoe becomes part of an electronic instrument, wherein the controlled movement of the shoe produces selected rhythms, notes or sounds. The ability of a person to artistically move their feet and thus their shoes is required in order to produce melodious sounds. Optional controls can be provided that enable a person to change the sounds or tones produced by the sound synthesizer circuit. Additionally, controls can be provided to selectively control the sensitivity of the trigger elements to different shoe movements.

In an optional embodiment, the multiple trigger elements embodied within a shoe are coupled to a musical instrument digital interface (MIDI). The MIDI converts the analog signal of the trigger elements into a digital signal that contains information about which of the trigger elements were flexed and how severely those trigger elements were flexed. The digital signal is then forwarded to a remote synthesizer of another instrument, such as an electronic keyboard, that is adapted to receive MIDI information.

BRIEF DESCRIPTION OF THE DRAWINGS

For a better understanding of the present invention, reference is made to the following description of two exemplary embodiments thereof, considered in conjunction with the accompanying drawings, in which.

DETAILED DESCRIPTION OF THE INVENTION

Although the present invention can be used in conjunction with any type of shoe, such as a hard-soled dress shoe or the like, the present invention is particularly well suited for use with soft-soled shoes such as sneakers and other athletic shoe wear. Accordingly, the present invention will be described in conjunction with a soft-soled athletic shoe in order to set forth the best mode contemplated for the invention.

Figure 1:
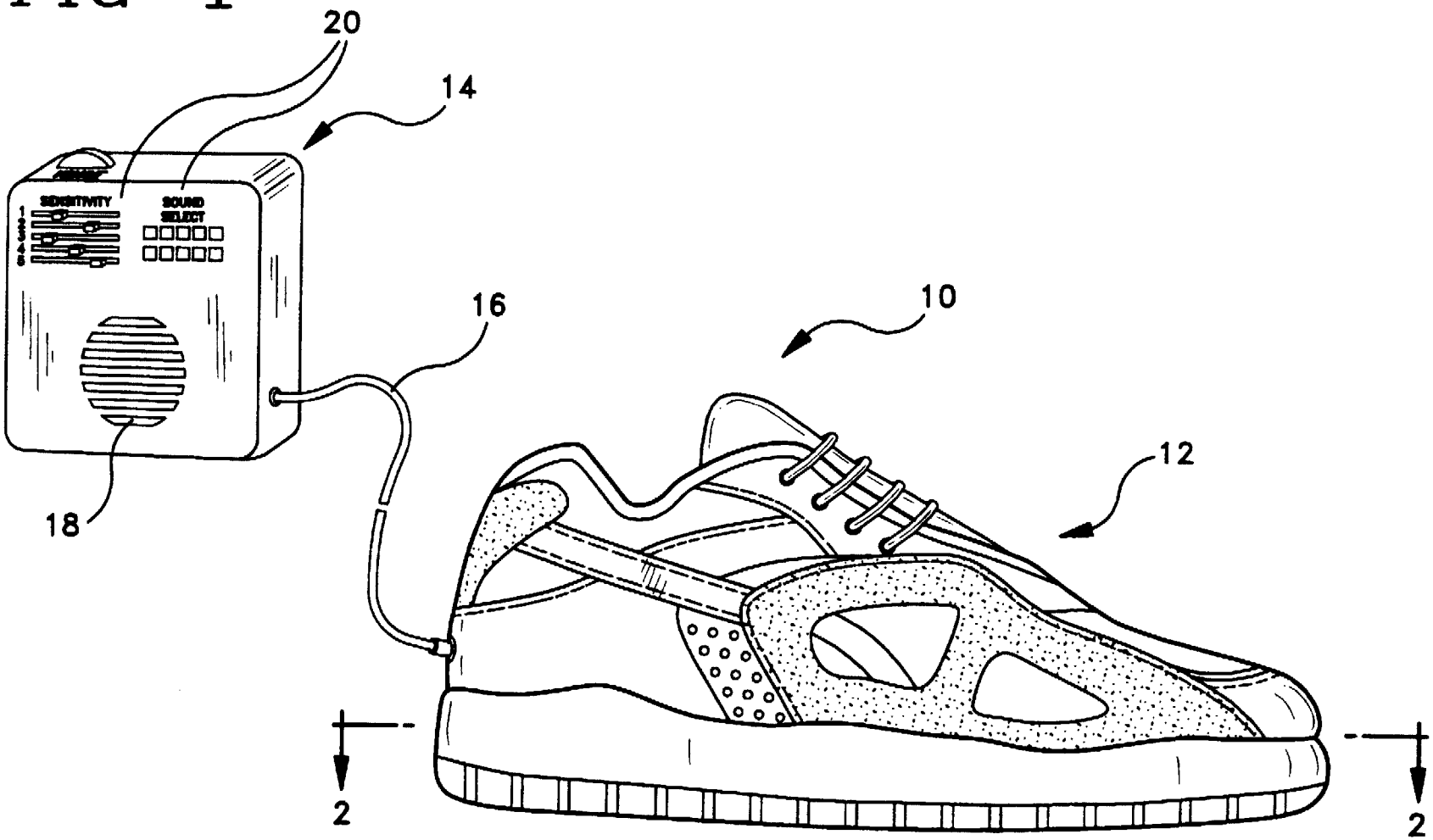
FIG. 1 is a side perspective view of one preferred embodiment of the present invention shoe activated sound synthesizer device.

Referring to FIG. 1, there is shown a first preferred embodiment of the present invention shoe activated sound synthesizer device 10. The present invention is comprised of a soft-soled athletic shoe 12 that is joined to a control box 14 by a cable 16. The control box 14 is a small lightweight assembly capable of being worn on a belt or clipped to the waistline of a pair of pants. As will later be explained in greater detail, the control box 14 contains a sound synthesizer. The sounds produced by the synthesizer are heard via a speaker 18 built into the control box 14. The type and volume of the sound produced by the synthesizer are selectively controlled by a variety of controls 20 accessible on the control box 14. Although only one shoe 12 is shown, it should be understood that two shoes will be worn. Both shoes to be worn contain identical components with regard to the present invention. As such, the physical description of a single shoe is descriptive of both shoes in a pair.

The sound synthesizer contained within the control box 14 preferably does not contain any memory storage of music. Rather, the sound synthesizer is trigger key activated, wherein when a specific trigger key is engaged, a specific corresponding sound is produced and broadcast by the sound synthesizer. The various trigger keys are contained within the structure of the athletic shoe 12, wherein the controlled manipulation of the athletic shoe 12 would enable a person to selectively control the activation of the various trigger keys and therefore selectively control the sounds produced by the synthesizer in the control box 14.

In the shown embodiment, the trigger signals produced by the trigger keys in the athletic shoe 12 are transmitted to the control box 14 via the cable 16. The cable 16 represents a simple, inexpensive way to exchange information between the control box 14 and the athletic shoe 12. However, it should be understood that other transmission technologies can be adapted to the present invention, such as wireless RF transmissions and wireless IR transmissions. Any such prior art point-to-point transmission technology is intended to be covered by the scope of this disclosure.

Figure 2:
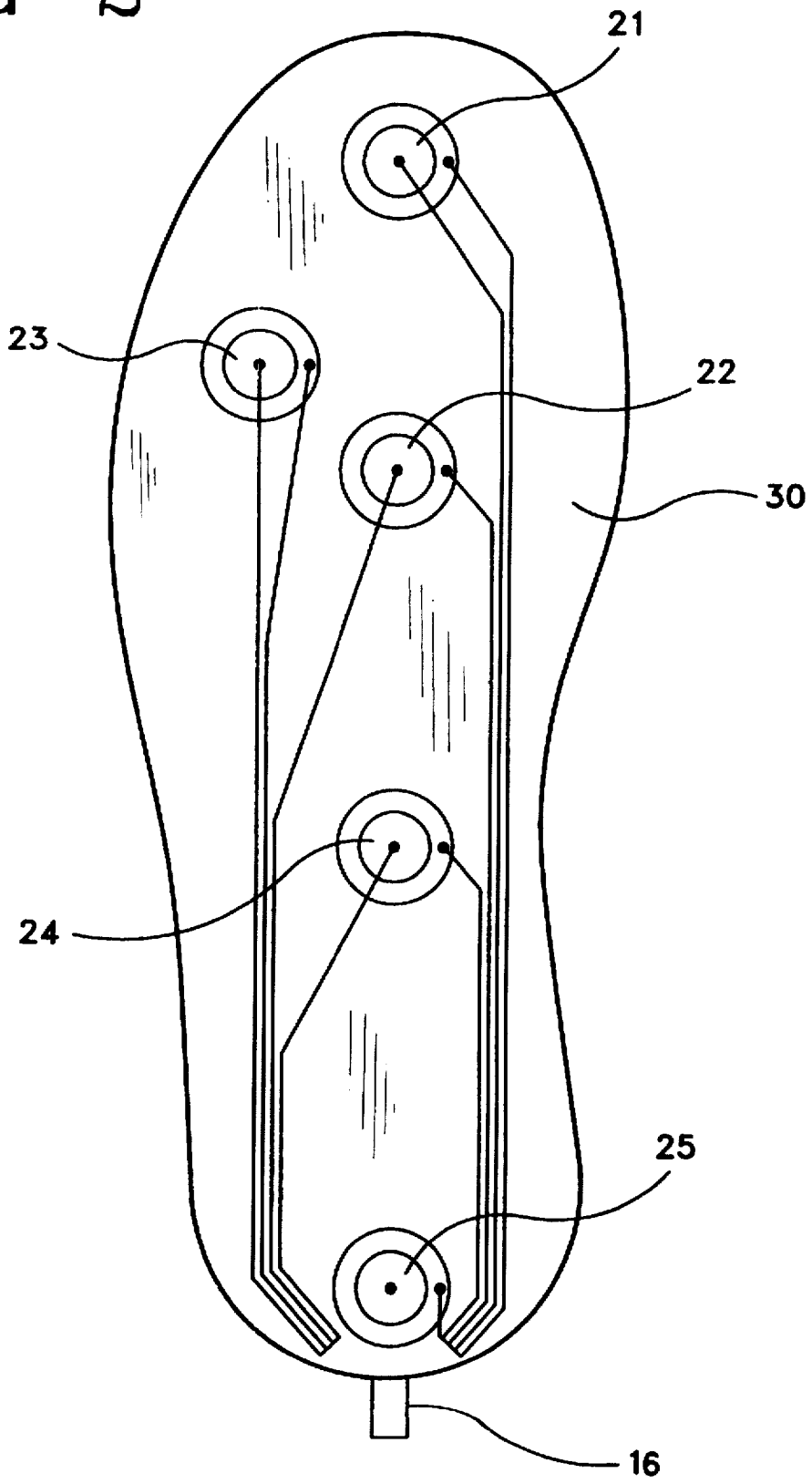
FIG. 2 is a cross-sectional view of the embodiment of the present invention shown in FIG. 1, viewed along section line 2—2.

Referring to FIG. 2, it can be seen that in the preferred embodiment, piezoelectric transducers 21, 22, 23, 24, 25 are used as the trigger keys within the sole structure 30 of the athletic shoe 12. In the preferred embodiment, a first piezoelectric element 21 is located proximate the toe of the sole structure 30. This first piezoelectric element 21 is flexed primarily when the person wearing the athletic shoe kicks down against the ground with the toe of the shoe, or is placing most of his/her body weight at the toe, such as when standing on tiptoes or sprinting. The second piezoelectric element 22 is located on the ball of the sole structure 30. As such, the second piezoelectric element 22 is flexed primarily when a person jumps, lands or otherwise places his/her weight on the ball of the foot. The third piezoelectric element 23 is located at the side of the sole structure 30. Therefore, the third piezoelectric element 23 is flexed primarily when a person steps to the side or otherwise shifts his/her weight to the side of the foot. The fourth piezoelectric element 24 is located in the arch of the sole structure 30. The fourth piezoelectric element 24, therefore, is flexed primarily when the arch is bent during running or walking. The last piezoelectric element 25 is located in the heel of the sole structure 30. As a result, the fifth piezoelectric element 25 is flexed primarily when a person lands on his/her heel when walking or running.

As one of the piezoelectric elements 21, 22, 23, 24, 25 is flexed, it produces a trigger signal indicative of the degree of flexure experienced by the piezoelectric element. As can be ascertained by the placement of the various piezoelectric elements within the sole structure 30 of the athletic shoe 12, different piezoelectric elements are triggered at different times depending on the movement of the athletic shoe 12. For example, if a person were running, the fifth piezoelectric element 25 in the heel of the sole structure 30 would be flexed as a person lands on the foot during stride. As the person's weight shifts from the heel of the foot to the ball of the foot, the arch flexes and the fourth piezoelectric element 24 is flexed. As the person's weight is fully transferred to the ball of the foot, the second piezoelectric element 22 is flexed. Lastly, as the person pushes forward on the toes to complete the stride, the first piezoelectric element 21 is flexed. As such, it will be understood that normal movement flexes some of the various piezoelectric elements at different times. By practicing selective movements, such as a dance step routine, each of the piezoelectric elements can be flexed in any one of a number of combinations.

Figure 3:
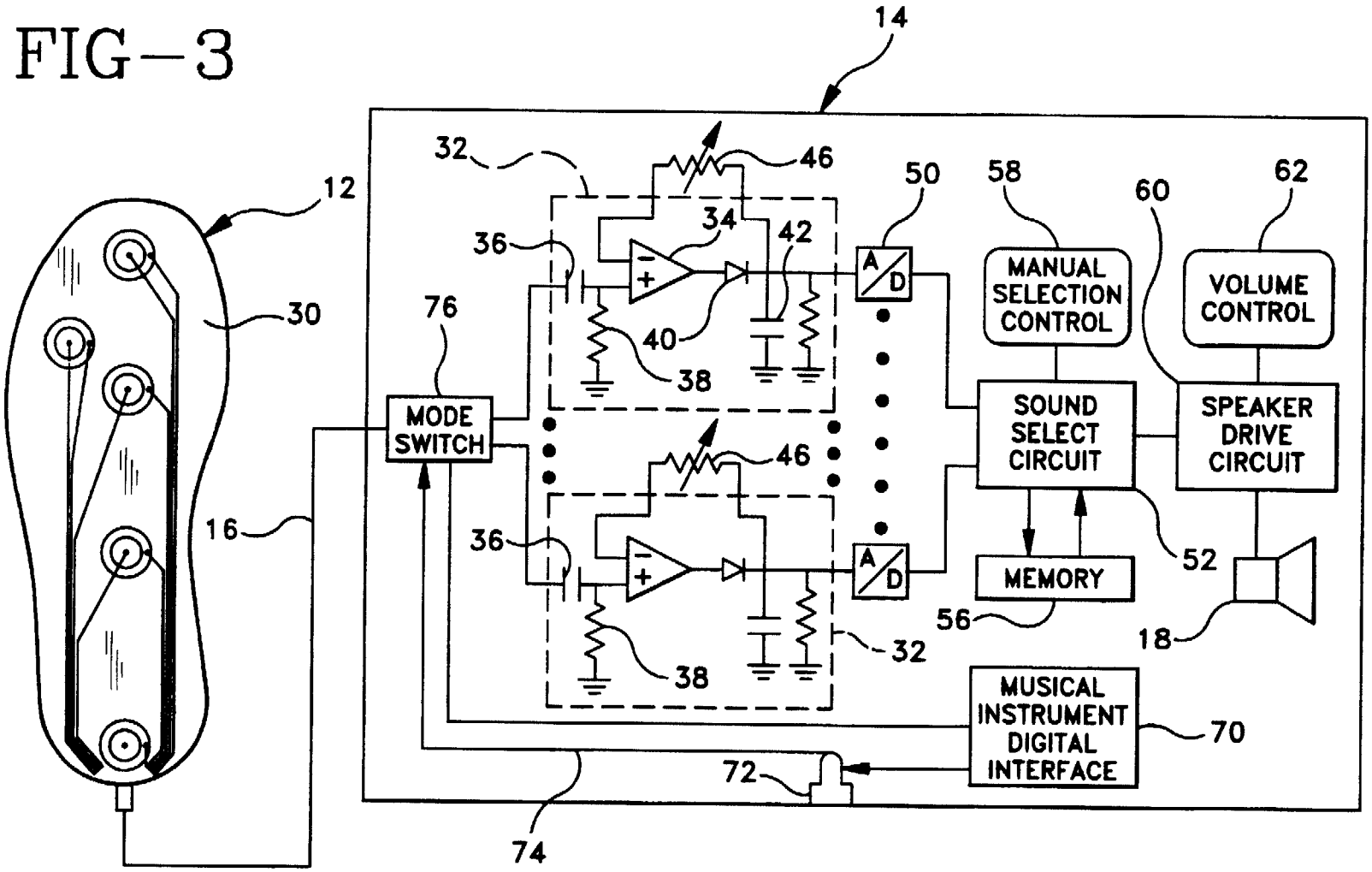
FIG. 3 is a schematic view showing the various electronic components contained in the preferred embodiment of the invention.

As can be seen from FIG. 2, each of the piezoelectric elements 21, 22, 23, 24, 25 is coupled to the cable 16 that extends out of the back of the sole structure 30 in the athletic shoe 12. Referring to FIG. 3, it can be seen that the cable 16 leads from the athletic shoe 12 into the control box 14. Within the control box 14, each of the piezoelectric elements on the sole structure 30 is coupled to a variable threshold circuit 32. The purpose of each variable threshold circuit 32 is to determine whether or not a corresponding piezoelectric element is flexed enough to warrant the production of a sound from the sound synthesizer. In the shown embodiment, the variable threshold circuit 32 contains an operational amplifier 34. A capacitor 36 and a grounded resistor 38 are connected to the input of the operational amplifier 34 to provide the proper signal shape at the amplifier input. The output of the operational amplifier 34 leads to a diode 40. The cathode of the diode 40 is coupled to a grounded time constant circuit having a capacitor 42 and resistor 44. The output of the diode 40 is fed back to the operational amplifier 34 via a variable resistor 46. The setting of the variable resistor 46 determines the sensitivity of the overall circuit. As such, by varying the setting of the variable resistor 46, the sensitivity of the signals from the various piezoelectric elements can be set at a selective threshold.

In the shown embodiment, each of the piezoelectric elements in the sole structure 30 of the athletic shoe 12 has a corresponding variable threshold circuit 32, wherein each variable threshold circuit 32 has its own variable resistor 46. Consequently, for the embodiment shown containing five piezoelectric elements, there would be five controls on the control box that would enable a user to selectively control the sensitivity of each part of the sole structure 30 of the athletic shoe 12. In an alternate embodiment, it should be understood that the various piezoelectric elements can be factory calibrated. The various variable threshold circuits can then be joined in parallel to a single variable resistor. Consequently, only one manual control for the variable resistor need be present on the control box 14.

Each variable threshold circuit 32 is coupled to an A/D converter 50 that converts the analog trigger signal from the variable threshold circuit 32 into a digital signal. The digital signal is fed into a sound select circuit 52, wherein the received digital signal is used to retrieve a predetermined sound from a memory source 56. A manual selection control 58 is coupled to the sound select circuit 52. Within the memory source 56 is contained at least one type of sound sampling. However, multiple sound samplings are preferred. For instance, within the memory source 56 there may be the sound samplings of a drum, wherein one particular drum sound is assigned to each of the variable threshold circuits 32. Each time a piezoelectric element is flexed and a trigger signal is received from a corresponding variable threshold circuit 32, a particular drum sound is retrieved from memory. The purpose of the manual selection control 58 is to vary what type of sound samplings are retrieved from the memory source 56. At a first setting, different drum noises can be assigned to each of the piezoelectric elements in the sole structure 30. In an alternate embodiment, sound samplings can be retrieved for an instrument such as a flute or an organ, wherein a different scale note is assigned to each of the piezoelectric elements in the sole structure 30. In yet another embodiment, real life sounds such as animal noises, grunts, football game noises, applause or different spoken words can be retrieved from the memory source 56. The manual selection control 58 enables a person in possession of the control box 14 to selectively choose the type of noises to be associated with the athletic shoes. For example, if the present invention is capable of five different types of noises, drum noises, flute noises, organ noises, dinosaur roars and animal noises, for example, the manual selection control 58 would have five settings to enable a person to choose between the settings.

In FIG. 3, it can be seen that the sound select circuit 52 is coupled to speaker drive circuit 60, wherein the various sounds retrieved from the memory source 56 by the sound select circuit 52 are converted into the proper speaker drive signal needed to produce those sounds. The speaker drive circuit 60 is coupled to the speaker 18 that converts the speaker drive signals into audible sounds. A volume control 62 is also coupled to the speaker drive circuit 60 to selectively control the volume of the speaker output.

As can be ascertained by the circuitry expressed in FIG. 3, any type of synthesized sound can be produced by the present invention device 10. The sole structure 30 of the shoe is the triggering mechanism which controls the production of synthesized sounds. As such, since different parts of the sole structure 30 trigger different notes or sounds, a person wearing the shoes of the present invention would have to develop a good deal of foot control skill, i.e. dancing skill, before a pleasant melodious tune could be created. Consequently, the present invention device can be considered a foot controlled instrument where artistic ability is required in order to produce pleasant results. Conversely, by assigning amusing sounds to the different parts of the sole structure 30, novelty shoes are produced that require no learned skill. For example, if different dinosaur roars were assigned to the various parts of the sole structure, a child would find great amusement in just running around.

The ability to adjust the sensitivity of the shoes also adds to the novelty aspect of the shoes. For example, by adjusting the sensitivity of the shoes to a point where only a hard stomp activates a sound, a person would only occasionally hear noises from their shoes. By retrieving grunt noises from memory, the shoes could have the appearance of complaining from being abused. For example, if a basketball player were running and came to a sudden stop, the shoes could say "ouch" or make a similar statement with a synthesized voice.

In FIG. 3 an optional musical instrument digital interface (MIDI) 70 is shown. The MIDI 70 is coupled directly to the cable 16 that extends to the shoe 12. Musical instrument digital interfaces are commonly used in modern electric powered musical instruments such as electronic drums and electronic keyboards. The musical instrument digital interface enables signals created from one instrument to generate sounds in a remote second instrument or at a remote synthesizer. In the shown embodiment, the MIDI 70 receives analog signals from the various piezoelectric elements within the sole structure 30 of the shoe 12. The MIDI 70 converts the analog signals into a digital signal that can be read by a remote synthesizer or another instrument, such as an electronic keyboard. The MIDI 70 is coupled to a plug port 72 on the side of the control box 14. The plug port 72 is adapted to receive a MIDI plug that connects the control box 14 to a remote synthesizer or instrument. The plug port 72 is also coupled to a lead 74 that extends to a mode switch 76. When a plug is placed into the plug port 72, the mode switch 76 is activated and the analog signals produced by the piezoelectric elements in the shoe 12 are directed solely to the MIDI 70. When no plug is present within the plug port 72, the mode switch 76 directs the analog signals produced by the piezoelectric elements toward the variable threshold circuits 32 and isolates the MIDI 70.

It will be understood that the presence of the MIDI 70 enables signals generated by the piezoelectric elements in the shoe 12 to be used to produce sounds in a remote synthesizer or musical instrument. As such, the present invention shoes can be connected to an electronic keyboard, wherein the movement of the shoes is translated into musical notes on that instrument.

Figure 4:
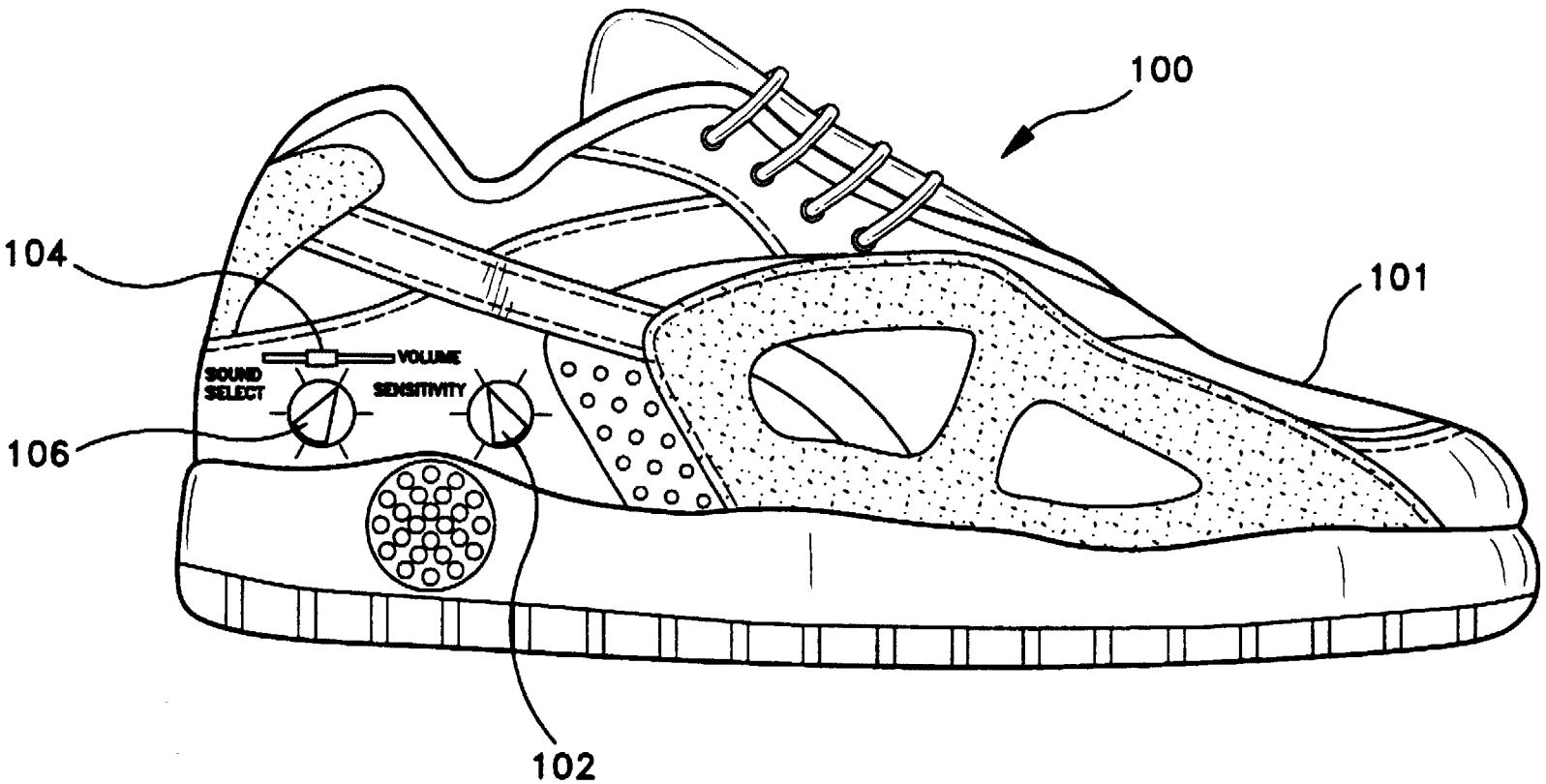
FIG. 4 is a side perspective view of an alternate embodiment of the present invention, wherein all the electronic components of the device are integrated into the structure of a shoe.

Referring to FIG. 4, an alternate embodiment of the shoe activated sound synthesizer device 100 is shown. In this embodiment, there is no separate control box as was present in the embodiment of FIG. 1. Rather, all the elements previously associated with the control box such as the speaker, speaker drive circuit, sound select circuit and variable threshold circuit can be integrated into the structure of the shoe 101 itself. Manual controls, such as the sensitivity control 102, volume control 104 and sound selection control 106 are also integrated into the athletic shoe 101 and are positioned at locations that are not likely to be contacted during use.

It will be understood that the two embodiments of the present invention shoe activated sound synthesizer device are merely exemplary and do not represent all embodiments intended to be included by the scope of this disclosure. For instance, the embodiments disclosed the use of piezoelectric elements in the sole of a shoe as the sound triggering mechanism. Although piezoelectric elements represent the best mode of a triggering mechanism, functionally equivalent components such as strain gauges, pressure sensors, acceleration switches, mercury switches and any other prior art switch capable of detecting contact of a shoe against the floor can be used. Similarly, the circuit diagram described in conjunction with FIG. 3 is also merely exemplary. Any circuitry capable of producing a synthesized sound in response to a triggering signal may be adapted for use in the present invention. All such alternate embodiments and modifications of the described invention are intended to be included in the scope of the invention as defined by the appended claims.

What is claimed is:

1. A device comprising:

a shoe having an external surface;

a plurality of trigger elements contained within said shoe, wherein each of said trigger elements is disposed at a separate location within said shoe and produces a unique trigger signal when said location of said shoe is deformed to a predetermined degree;

a sound synthesizer circuit contained within said shoe, wherein said sound synthesizer circuit is coupled to said plurality of trigger elements for generating a different sound signal in response to each said trigger signal;

a first manual control accessible on said exterior of said shoe, wherein said first manual control is coupled to said sound synthesizer circuit and is used to alter said sound signal produced by said sound synthesizer circuit in response to any said trigger signal and a speaker contained within said shoe, wherein said speaker is coupled to said sound synthesizer circuit and converts each said sound signal into an audible sound.

2. The device according to claim 1, further including a second manual control accessible on said exterior of said shoe for selectively altering said predetermined degree that said shoe must be deformed to produce each said trigger signal from said plurality of trigger elements.

3. The device according to claim 1, wherein each said audible sound produced by said speaker is at a predetermined volume and said device further includes a manual control accessible on said exterior of said shoe for selectively altering said predetermined volume.

4. The device according to claim 1, wherein said shoe has a flexible sole and said plurality of trigger elements include piezoelectric elements coupled to said flexible sole.

5. The device according to claim 1, wherein said plurality of trigger elements include at least one trigger element located proximate the toe of said shoe, proximate the heel of said shoe and proximate the ball of the sole of said shoe.

6. The device according to claim 1, wherein said sound synthesizer circuit includes a memory that contains a plurality of types of sounds and said first manual control selectively controls which of said types of sounds said sound synthesizer circuit will produce.

7. The device according to claim 1 wherein each said different sound signal corresponds to a different drum sound.

8. The device according to claim 1, wherein said shoe is an athletic shoe.

9. The device according to claim 1, further including a musical instrument digital interface coupled to said at least one trigger element for producing a digital signal for each said trigger signal.

10. A device comprising:

a shoe having a sole;

a plurality of trigger elements contained within said shoe, wherein each of said trigger elements is disposed at a separate location within said shoe and produces a unique trigger signal when said location of said shoe is deformed to a predetermined degree;

a sound synthesizer circuit coupled to said plurality of trigger elements for generating a sound signal in response to each said trigger signal;

at least one first manual control for selectively altering said predetermined degree that said shoe must be deformed to produce each said trigger signal from said plurality of trigger elements; and a speaker coupled to said sound synthesizer circuit for converting each said sound signal into an audible sound.

11. The device according to claim 10 wherein said at least one first manual control is configured to contain a plurality of manual controls wherein each of said manual controls selectively controls said predetermined degree of shoe deformation required to produce a trigger signal from one of said plurality of trigger elements.

12. The device according to claim 10 wherein said sound synthesizer produces one sound signal from a plurality of different sound signals in response to each said trigger signal and said device further includes a second manual control coupled to said sound synthesizer circuit for selectively altering said sound signal produced by said sound synthesizer circuit in response to any said trigger signal.

* * * * *